US007500760B2

(12) United States Patent
Byrne

(10) Patent No.: US 7,500,760 B2
(45) Date of Patent: Mar. 10, 2009

(54) LIGHT WITH HEATER

(75) Inventor: Brendan Patrick Byrne, Germantown, TN (US)

(73) Assignee: Hunter Fan Company, Memphis, TN (US)

( * ) Notice: Subject to any disclaimer, the term of this patent is extended or adjusted under 35 U.S.C. 154(b) by 57 days.

(21) Appl. No.: 11/713,872

(22) Filed: Mar. 4, 2007

(65) Prior Publication Data

US 2008/0212308 A1 Sep. 4, 2008

(51) Int. Cl.
*F21V 33/00* (2006.01)

(52) U.S. Cl. ..... 362/92; 362/364; 362/345; 392/356; 392/358; 392/361

(58) Field of Classification Search ..... 362/92, 362/373, 365, 96, 91, 264, 294, 364, 437; 392/361

See application file for complete search history.

(56) References Cited

U.S. PATENT DOCUMENTS

| | | | | |
|---|---|---|---|---|
| 2,010,322 | A | 8/1935 | Riddell | |
| 2,189,008 | A | 2/1940 | Kurth | |
| 2,689,906 | A | 9/1954 | Corbett | |
| 3,025,379 | A | 3/1962 | Ford | |
| 3,068,341 | A | 12/1962 | Ortiz et al. | |
| 3,141,086 | A | 7/1964 | Prager | |
| 3,786,233 | A | 1/1974 | Bumpus et al. | |
| 3,958,100 | A | 5/1976 | Stone | |
| 4,681,024 | A * | 7/1987 | Ivey | 454/233 |
| 5,021,932 | A | 6/1991 | Ivey | |
| 5,077,825 | A | 12/1991 | Monrose | |
| 5,333,235 | A | 7/1994 | Ryder | |
| 5,425,126 | A | 6/1995 | Lee | |
| D381,074 | S | 7/1997 | Pelonis | |
| 5,668,920 | A | 9/1997 | Pelonis | |
| D404,123 | S | 1/1999 | Pelonis | |
| 5,909,534 | A * | 6/1999 | Ko | 392/376 |
| D435,094 | S | 12/2000 | Bucher | |
| 6,240,247 | B1 | 5/2001 | Reiker | |
| 6,438,322 | B1 | 8/2002 | Reiker | |
| 6,477,321 | B2 | 11/2002 | Reiker | |
| 6,631,243 | B2 | 10/2003 | Reiker | |
| 6,751,406 | B2 | 6/2004 | Reiker | |
| 2005/0105302 | A1 * | 5/2005 | Hofmann et al. | 362/555 |

* cited by examiner

*Primary Examiner*—Ali Alavi
*Assistant Examiner*—Evan Dzierzynski
(74) *Attorney, Agent, or Firm*—Baker Donelson et al.

(57) ABSTRACT

A light fixture (10) is provided having an upper housing (11), a light diffusor (12), a light source (13), and a heating source (14). The housing includes a mounting plate (17) adapted to be mounted to the ceiling of a structure in conventional fashion. The upper housing includes an upper wall, two oppositely disposed side walls (18), a bottom wall (19) spanning the side walls, and an annular airflow ring (21). The bottom wall has a central opening (23) therein. The airflow ring has a plurality of air exhaust holes (24) and a plurality of air intake holes (25). The mounting plate, bottom wall, and two side walls form an air channel (28) in fluid communication with the exhaust holes of the airflow ring. The heat source includes a pair of heating elements (38) mounted within the airflow channel and a motorized fan (39).

12 Claims, 2 Drawing Sheets

LIGHT WITH HEATER

TECHNICAL FIELD

This invention relates generally to light fixtures, and more particularly to light fixtures having heating capabilities.

BACKGROUND OF THE INVENTION

Lighting fixtures have existed for many years. Recently, some lighting fixtures have incorporated heaters to warm the surrounding air. These light fixtures are typically placed in a bathroom so as to heat the room in order to make it more comfortable for people after taking a shower or bath. As such, these light fixtures are not designed to blend into the more formal aesthetics of other rooms within a typical home.

Accordingly, it is seen that a need remains for a light fixture that can provide heat but which is unobtrusive and easy to maintain. It is to the provision of such therefore that the present invention is primarily directed.

SUMMARY OF THE INVENTION

In a preferred form of the invention, a light fixture comprises an upper housing having an upper wall, a bottom wall having an opening therethrough, and side walls which in combination with the upper wall and the bottom wall define an air channel. The upper housing also includes an airflow ring positioned adjacent the air channel. The airflow ring includes at least one air intake hole and at least one air exhaust hole. The light fixture also has a light diffusor coupled to the upper housing, a light source coupled to the housing, and a heat source coupled to the housing to heat air passing through the housing air channel. The heat source also including a fan for creating an airstream. With this construction, the actuation of the fan draws air into the light fixture through the air intake holes, through the central opening in the bottom wall and into the air channel, and exits the light fixture through the exhaust hole within the airflow ring, and whereby the heat source heats the airstream created by the fan.

DETAILED DESCRIPTION

Figure 1:
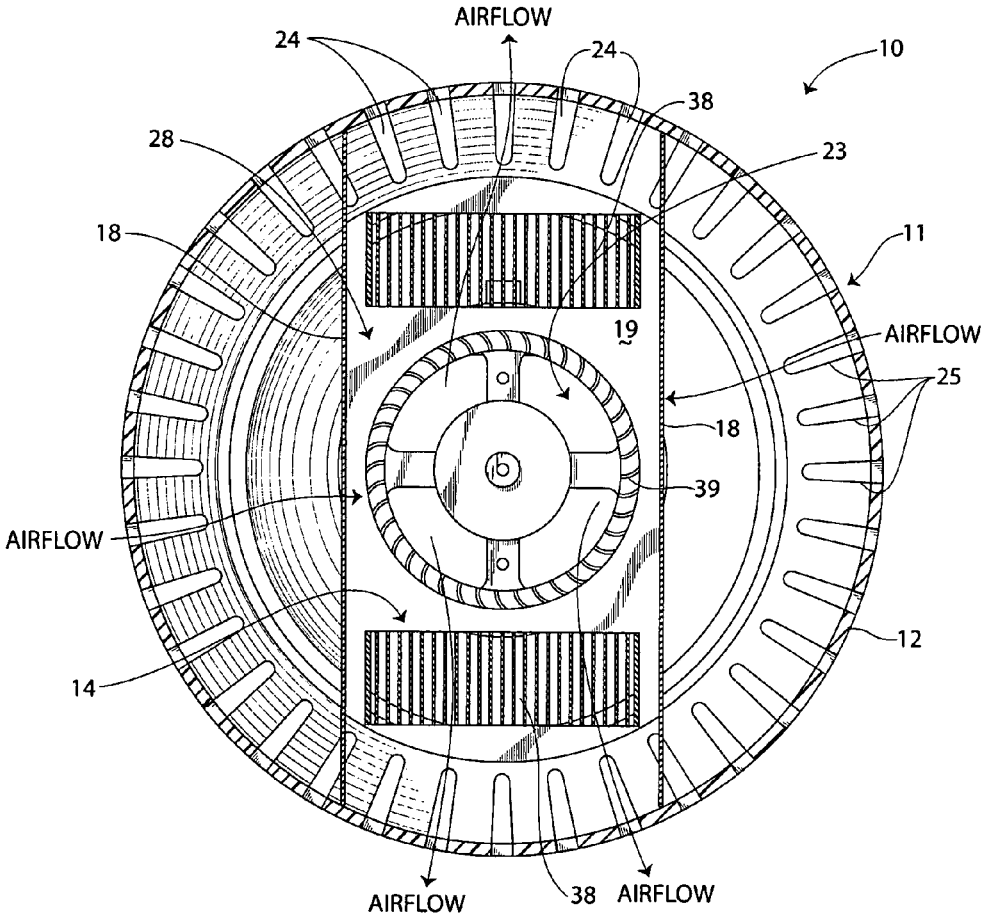
FIG. 1 is a top view of a light fixture of the present invention.
Figure 2:
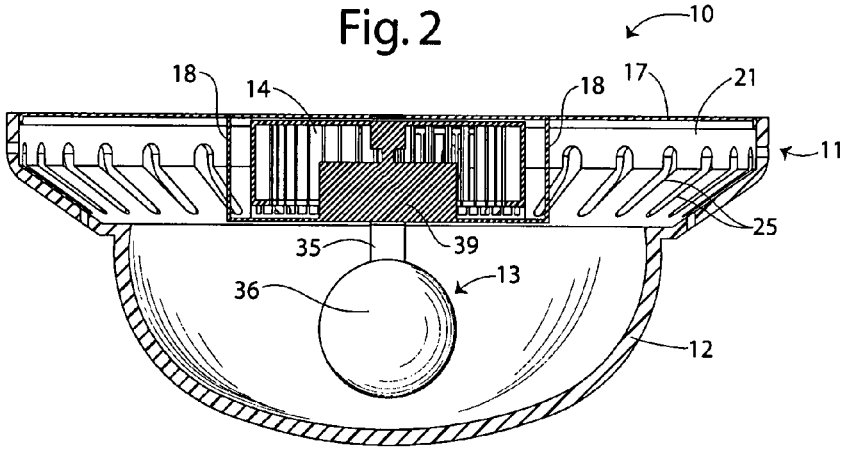
FIG. 2 is a front view of the light fixture of FIG. 1.
Figure 3:
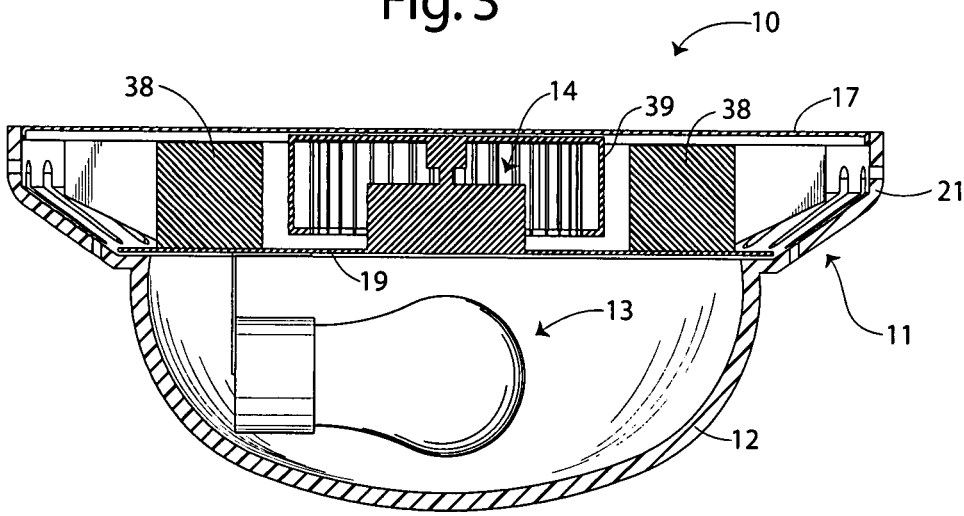
FIG. 3 is a side view of the light fixture of FIG. 1.
Figure 4:
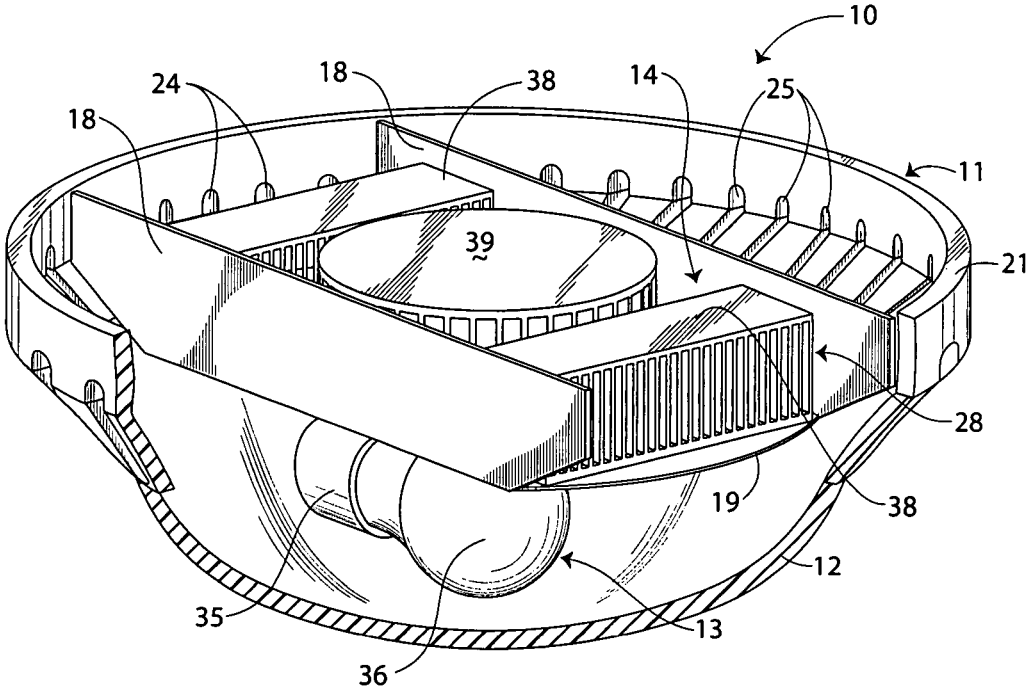
FIG. 4 is a perspective view of a portion of the light fixture of FIG. 1.

With reference next to the drawings, there is shown a light fixture 10 in a preferred form of the invention. The light fixture 10 includes an upper housing 11, a translucent shade or light diffusor 12, a light source 13, and a heating source 14.

The upper housing 11 includes an upper wall, shown in the form of a mounting plate 17 adapted to be mounted to the ceiling or junction box of a structure in conventional fashion. The upper housing 11 also includes two oppositely disposed side walls 18, a bottom wall 19 spanning the side walls 18, and an annular airflow ring 21 positioned about the side walls 18 and coupled to the light diffusor 12. The bottom wall 19 has a central opening 23 therein. The airflow ring 21 has a plurality of air exhaust holes 24 generally positioned between the ends of the two sidewalls 18 and a plurality of air intake holes 25 positioned outboard of the side walls 18. The mounting plate 17, bottom wall 19, and two side walls 18 form an air channel 28 having an air intake (central opening 23) in fluid communication with airflow ring intake holes 25 and two oppositely disposed air exits 26 positioned closely adjacent and in fluid communication with the exhaust holes 24 of the airflow ring.

The light source 13 includes a light socket 35 mounted to the housing bottom wall 19. The light socket 35 is electrically coupled to electrical wires which are coupleable to the electric wires within a home in conventional fashion. A light bulb 36 is mounted within the light socket 35.

The heat source 14 includes a pair of heating elements 38 mounted within the airflow channel 28 opposite sides of central opening 23. The heating elements 38 may be positive temperature coefficient heaters (PTC heaters). The heat source 14 also includes a motorized fan 39 in fluid communication with the bottom wall opening 23 to create an air flow, as indicated by the arrows in the drawings, which enters the light fixture 10 through the air intake holes 25 of the airflow ring, flows through the central opening 23, through the fan 39, through the heating elements 38, and exits through the exhaust holes 24 in the airflow ring. The heating elements 38 and motorized fan 39 are coupled to the home wiring in conventional fashion.

In use, the light fixture may be used as a light, as a heater, or as both a light and a heater. The light source and/or heat source may be supplied with an electric current through the electrical wires through any conventional switch, such as a wall switch, a switch mounted to the device itself such as a pull cord switch, or a remote controlled switch such as an RF control circuit. During use as a heater or as a combination light and heater, the fan 39 creates and airstream that is heated by the heating element 38 and is passed through air channel 28 and expelled from the housing 11 through the airflow ring exhaust holes 24.

The exhaust holes 24 within the airflow ring 21 allow the heated air to be directed downwardly to efficiently heat a room, rather than being directed upwardly towards the ceiling.

It should be understood that the light fixture of the present invention may includes light fixtures coupled to ceiling fans, rather than directly to the ceiling or wall of a structure. As such, the upper wall could be any wall and is therefore not limited to the configuration of a mounting plate shown in the preferred embodiment. It should also be understood that other types of electric fans and electric heaters may be utilized as an alternative to those shown in the preferred embodiment. Lastly, it should be understood that the airflow ring may be configured in any shape and is therefore not limited to the annular appearance of the preferred embodiment. As such, the term airflow ring may denote any shape, such as a square, rectangle, oval, polygon, or other shape, including, but not limited to circular shapes.

It thus is seen that a light fixture is now provided which provides heat but which is unobtrusive. While this invention has been described in detail with particular reference to the preferred embodiment thereof, it should be understood that many modification, additions and deletions, may be made thereto without departure from the spirit and scope of the invention as set forth in the following claims.

The inventioned claimed is:

1. A light fixture comprising, an internal housing having an upper wall, a bottom wall having an opening therethrough, and sidewalls which in combination with said upper wall and said bottom wall define an air channel, an external housing coupled to said internal housing and including an airflow ring having sidewalls positioned about said air channel, said airflow ring including at least one air intake hole extending through said sidewalls and at least one air exhaust hole extending through said sidewalls;

a light diffuser;

a light source coupled to said internal housing;

a heat source coupled to said internal housing to heat air passing through said internal housing air channel, said heat source includes a fan for creating an airstream through said air channel, whereby the actuation of the fan draws air into the light fixture through the air intake holes, through the central opening in the bottom wall and into the air channel, and exits the light fixture through the exhaust hole within the airflow ring, and whereby the heat source heats the airstream created by the fan.

2. The light fixture of claim 1 wherein said airflow ring includes at least two oppositely disposed air exhaust holes.

3. The light fixture of claim 2 wherein said airflow ring also includes at least two oppositely disposed air exhaust holes.

4. The light fixture of claim 1 wherein said airflow ring includes at least two oppositely disposed air intake holes.

5. The light fixture of claim 1 wherein said heat source is a positive temperature coefficient heater.

6. The light fixture of claim 1 wherein said fan is a centrifugal type fan.

7. The light fixture of claim 1 wherein said heat source is positioned within said air channel.

8. A light fixture mountable to an overlying structure, the light fixture comprising, an internal housing defining an internal air channel extending from an air inlet and at least one air exit, an external housing coupled to said internal housing, said external housing including a housing ring encircling said internal housing and having at least one air inlet hole extending through said housing ring sidewall and in fluid communication with said internal housing air channel air inlet and at least one air exhaust hole extending through said housing ring sidewall and in fluid communication with said internal housing air channel air exit;

a light source coupled to said housing;

a heat source positioned within said internal housing to heat an airstream passing through said housing air channel; and a fan adapted to create an airstream through said air channel, whereby an airstream passing through the internal housing is heated by the heat source and expelled from the exhaust hole in the external housing ring.

9. The light fixture of claim 8 wherein said external housing ring includes at least two oppositely disposed exhaust holes.

10. The light fixture of claim 8 wherein said heat source is a positive temperature coefficient heater.

11. The light fixture of claim 8 further comprising a light diffuser coupled to said internal housing.

12. The light fixture of claim 8 wherein said heat source is positioned within said air channel.

* * * * *